US008622387B2

(12) United States Patent
Kuo et al.

(10) Patent No.: US 8,622,387 B2
(45) Date of Patent: Jan. 7, 2014

(54) PAPER OUT MECHANISM AND PRINTING APPARATUS WITH PAPER OUT MECHANISM

(71) Applicant: Hon Hai Precision Industry Co., Ltd., New Taipei (TW)

(72) Inventors: Hsin-Hsien Kuo, New Taipei (TW); Chin-Ta Ma, New Taipei (TW); Jian-Da Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/796,963

(22) Filed: Mar. 12, 2013

(65) Prior Publication Data

US 2013/0313772 A1 Nov. 28, 2013

(30) Foreign Application Priority Data

May 25, 2012 (TW) ..... 101118810 A

(51) Int. Cl.
*B65H 31/04* (2006.01)

(52) U.S. Cl.
USPC ..... 271/213; 271/207

(58) Field of Classification Search
USPC ..... 271/145, 164, 171, 207, 213
See application file for complete search history.

(56) References Cited

U.S. PATENT DOCUMENTS 5,959,956 A * 9/1999 Takishima ..... 720/607

FOREIGN PATENT DOCUMENTS

JP 04333462 A * 11/1992 ..... B65H 31/20

* cited by examiner

*Primary Examiner* — Michael McCullough
(74) *Attorney, Agent, or Firm* — Altis Law Group, Inc.

(57) ABSTRACT

A paper out mechanism includes a paper tray, a holding tray, and an actuating device. The holding tray is slidably attached to the paper tray. The actuating device is located on the paper tray and meshed with the holding tray. The holding tray is slidable relative to the paper tray driven by the actuating device.

16 Claims, 8 Drawing Sheets

PAPER OUT MECHANISM AND PRINTING APPARATUS WITH PAPER OUT MECHANISM

BACKGROUND

1. Technical Field

The present disclosure relates to printing apparatuses, and more particularly to a printing apparatus with a paper out mechanism.

2. Description of Related Art

A printing apparatus may include a printing body and a paper tray secured to the printing body. The paper tray is configured to receive a printed paper from the printing body and stretchable to receive different size of printed papers. When the printing apparatus needs to print different size of papers, it is very inconvenient to manually stretch or retract the paper tray to satisfy the size of the papers every time. Therefore, there is room in the art for improvement.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
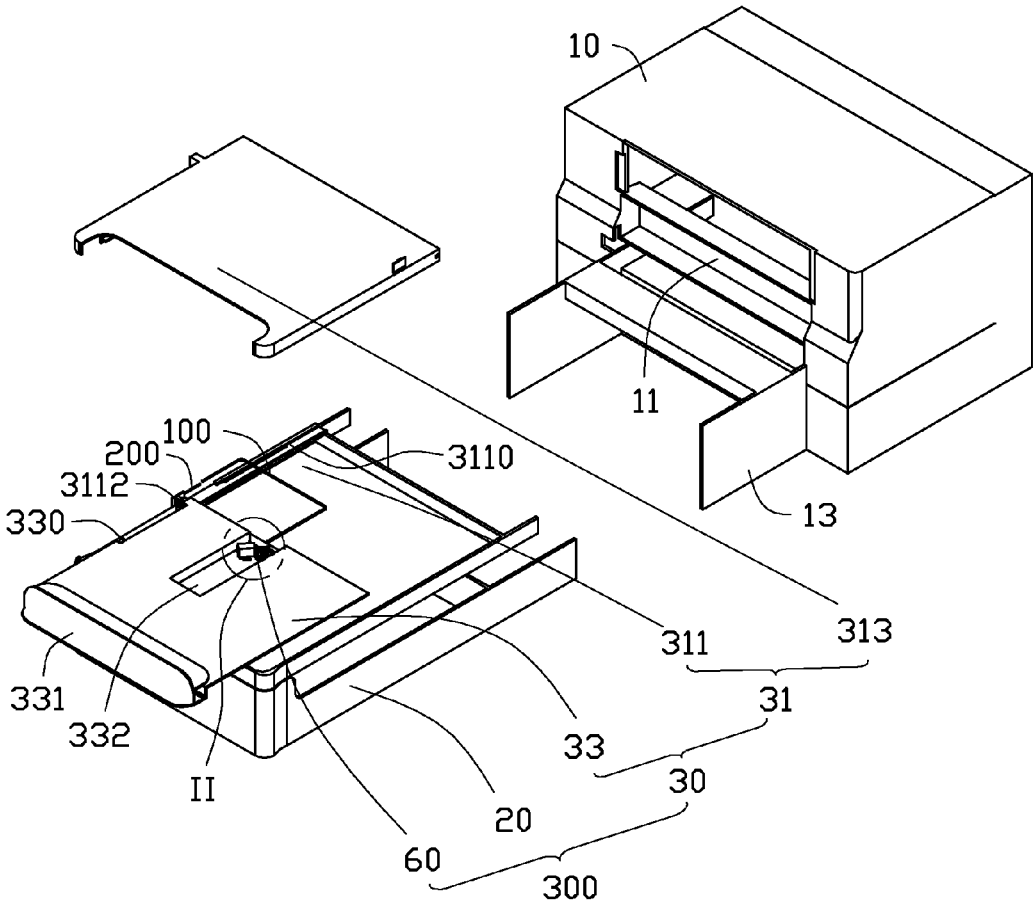
FIG. 1 is an exploded, isometric view of a printing apparatus in accordance with an embodiment.
Figure 2:
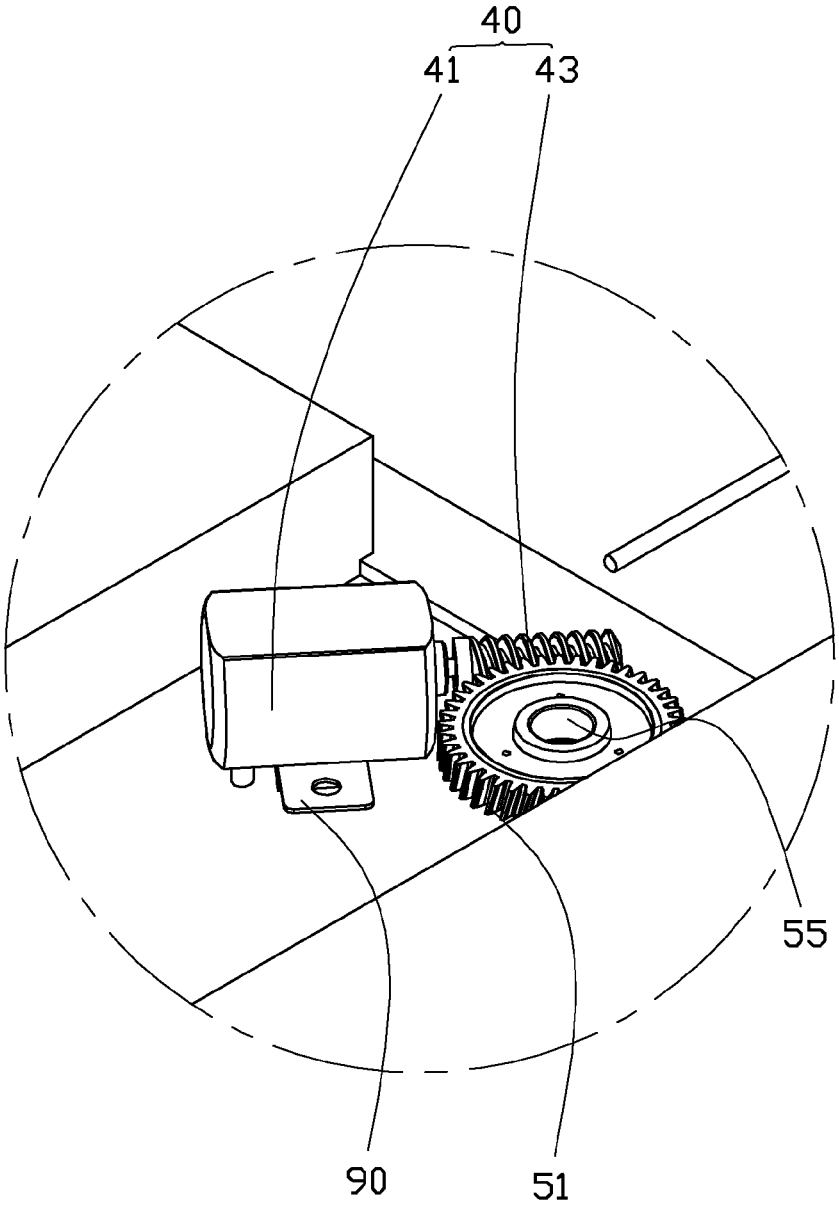
FIG. 2 is an enlarged view of the circled portion II of FIG. 1.

FIGS. 1-2 illustrate a printing apparatus in accordance with an embodiment. The printing apparatus includes a printing body 10 and a paper out mechanism 300.

The printing body 10 defines a paper out opening 11. Two mounting boards 13 are located on two opposite sides of the paper out opening 11. The two mounting boards 13 are secured to the printing body 10 via a common fixed mode, such as, a screw locking mode and a buckling mode.

Figure 4:
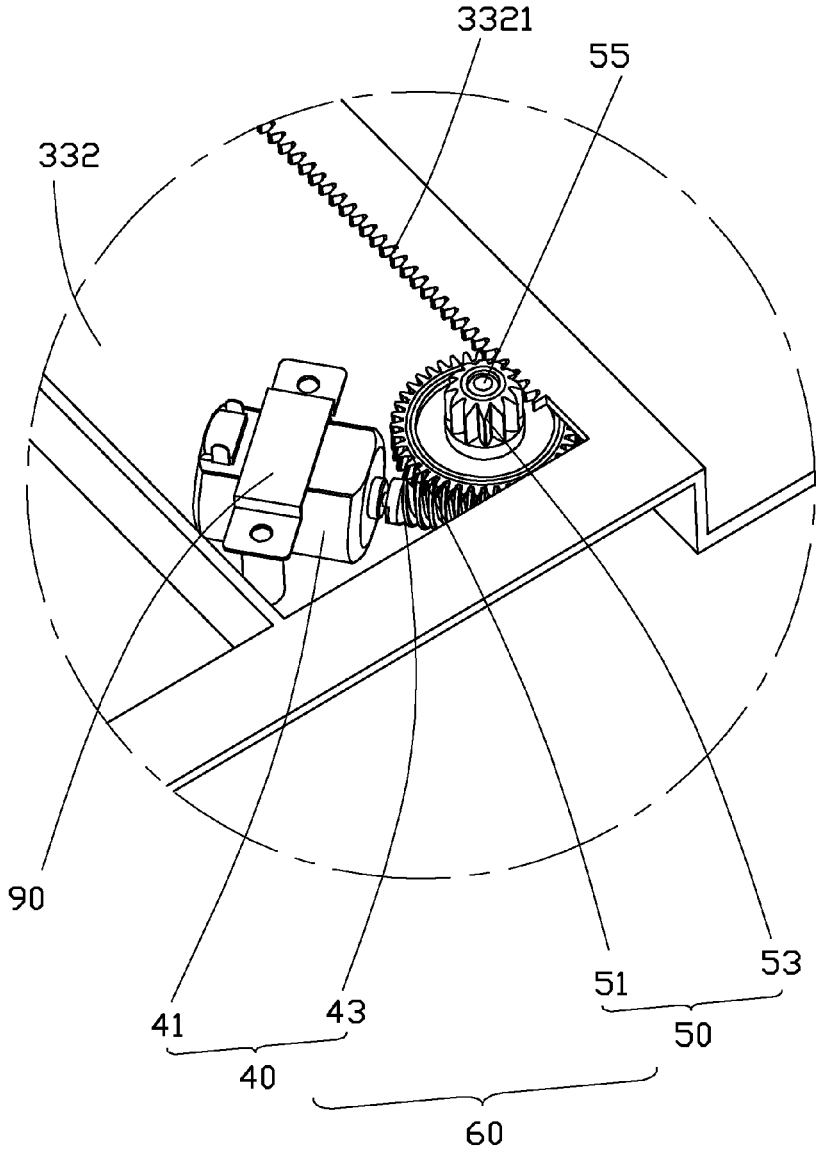
FIG. 4 is an enlarged view of the circled portion IV of FIG. 3.

The paper out mechanism 300 includes a support base 20, a paper out tray assembly 30 secured to the support base 20, and an actuating device 60. FIG. 4 shows that the actuating device 60 includes an actuating structure 40 and a driving gear 50. The paper out tray assembly 30 is capable of receiving different size of a first paper 70 (shown in FIG. 6) and a second paper 80 (shown in FIG. 8). A size of the first paper 70 is smaller than a size of the second paper 80.

The paper out tray assembly 30 includes a paper tray 31 and a holding tray 33 slidably secured to the paper tray 31.

Figure 3:
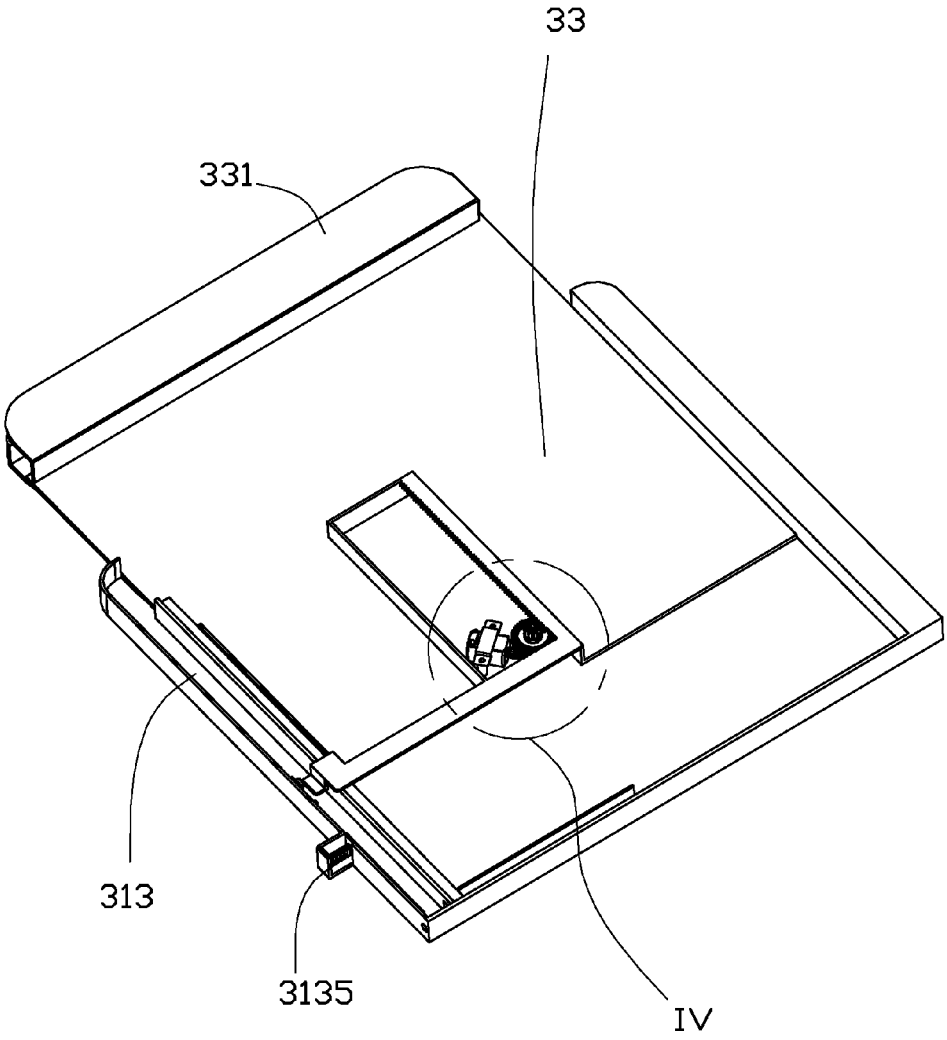
FIG. 3 is an isometric view of a paper out mechanism of FIG. 1.

The paper tray 31 includes an installation portion 311 secured to the support base 20 and a bearing board 313 secured to the installation portion 311. In one embodiment, the installation portion 311 is a box. A sliding rail 3110 is defined in one side of the installation portion 311, and a sensor 3112 is fixed on one end of the sliding rail 3110. Two stopping posts 3131 and an installation post 3133 protrude from an inner side of the bearing board 313. The two stopping posts 3131 are engaged with a locking member 90 to secure the actuating structure 40 to the bearing board 313. The locking member 90 defines two locking holes 91 for receiving the two stopping posts 3131. In one embodiment, the installation portion 311 directly defines two receiving holes for receiving the two stopping posts 3131. A controller 3135 (shown in FIG. 3) is mounted on one side of the bearing board 313.

Figure 5:
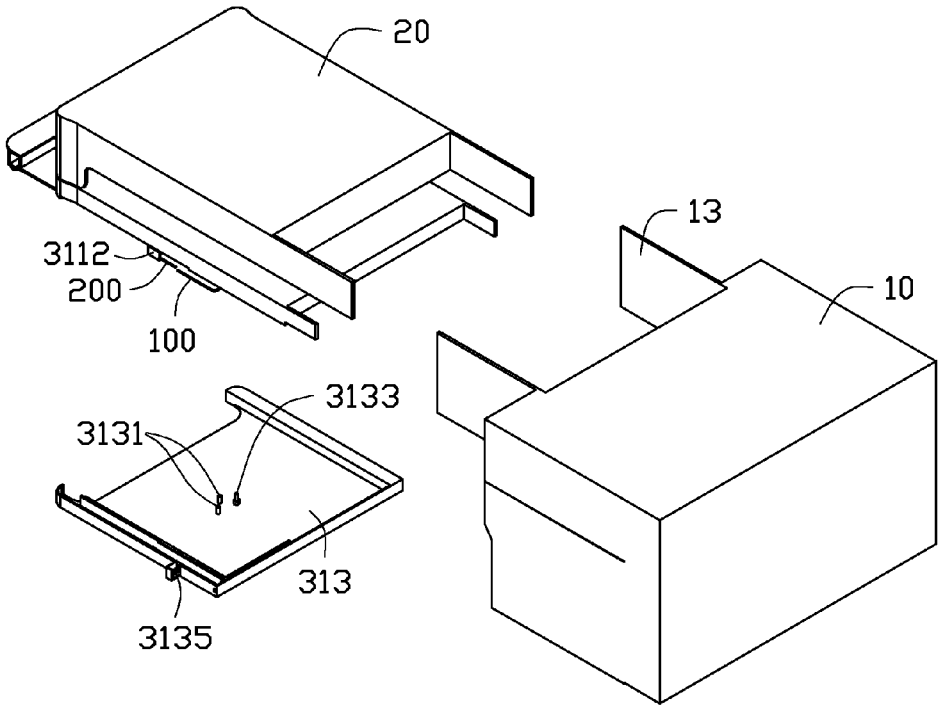
FIG. 5 is a similar to FIG. 1, but shows from a different aspect.

FIGS. 4 and 5 show that two sliding posts 330 are located on one side of the holding tray 33 and slidably received in the sliding rail 3110. A blocking member 331 is located on an end of the holding tray 33 and configured to prevent the first paper 70 and the second paper 80 from sliding out of the paper out tray assembly 30. The holding tray 33 defines a receiving slot 332 facing the paper tray 31 for receiving the actuating structure 40. In one embodiment, the receiving slot is substantially U-shaped. A plurality of teeth 3321 are formed on one edge of the receiving slot 332.

The actuating structure 40 is installed on the bearing board 313 and includes a drive 41 and a worm 43 connected to the drive 41. The drive 41 rotates the worm 43. In one embodiment, the drive 41 is a motor. The controller 3135 is electrically connected to the drive 41 via a first cable 100 and connected to the sensor 3112 via a second cable 200. The controller 3135 is capable of detecting if there is printed paper outputted from the paper out opening 11 and determines the size of the printed paper, then starts the drive 41 working. The sensor 3112 detects outputted length of the holding tray 33 relative to the paper tray 31 and transfers signals to the controller 3135. The controller 3135 stops the drive 41 from working.

The driving gear 50 is attached to the bearing board 313 and includes a first gear 51 and a second gear 53 having a same rotation axis as the first gear 51. The first gear 51 is meshed with the worm 43. The second gear 53 is meshed with the plurality of teeth 3321 of the holding tray 33. The first gear 51 has a first addendum circle, and the second gear 53 has a second addendum circle. In one embodiment, the first addendum circle is greater than the second addendum circle. The driving gear 50 defines a positioning hole 55 extending through the first gear 51 and the second gear 53.

Figure 7:
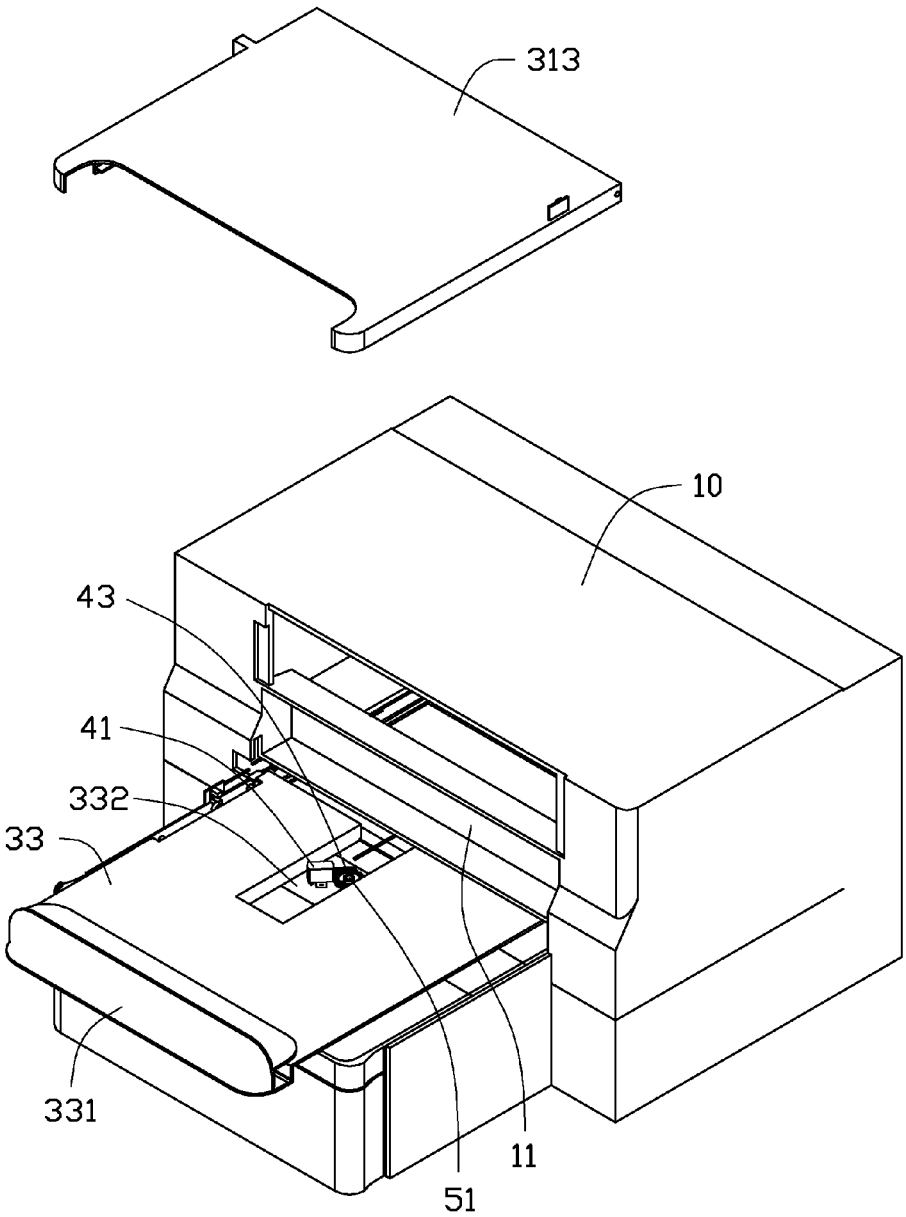
FIG. 7 is a partially assembled view of FIG. 1.

FIG. 7 shows that in assembly, the two stopping posts 3131 are respectively inserted into the two locking holes 91 of the locking member 90. The installation post 3133 is received in the positioning hole 55 to secure the actuating structure 40 to the bearing board 313. The bearing board 313 is secured to the installation portion 311 via a common fastening method, such as a screw locking, a buckling mode for example. The support base 20 is secured to the two mounting boards 13. The holding tray 33 is slidable relative to the paper tray 31 between a first position, where the holding tray 33 is received between the installation portion 311 and the bearing board 313 and the blocking member 331 abuts against the bearing board 313, and a second position, where the holding tray 33 extends out of the paper tray 31.

Figure 6:
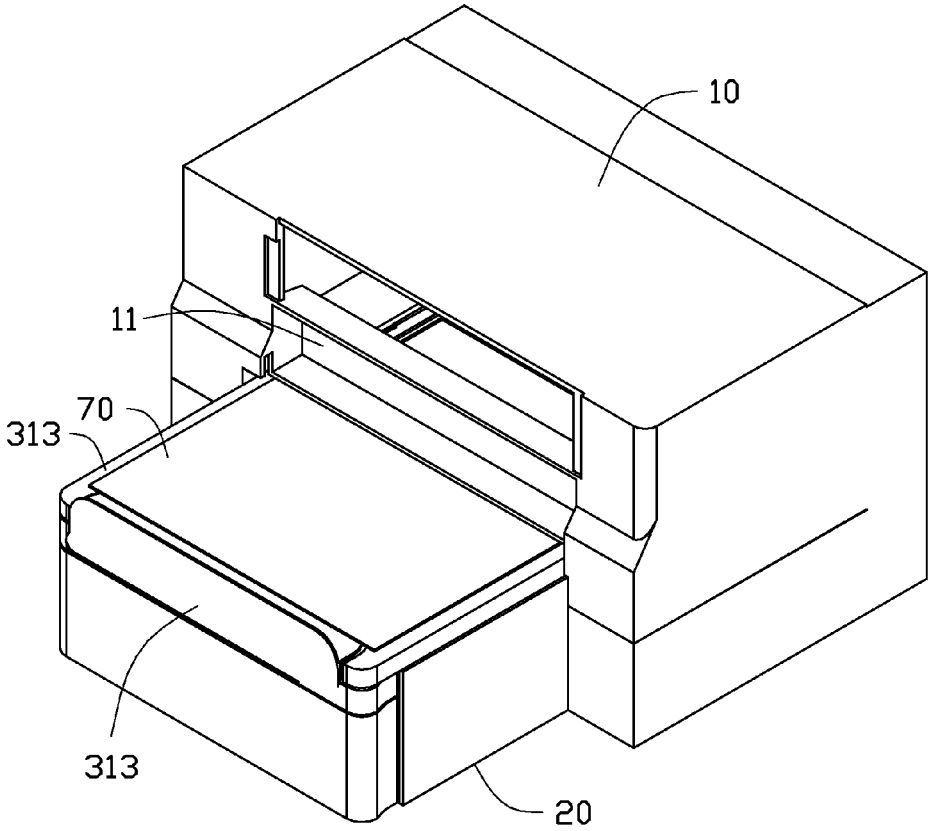
FIG. 6 is an assembled view of FIG. 1.
Figure 8:
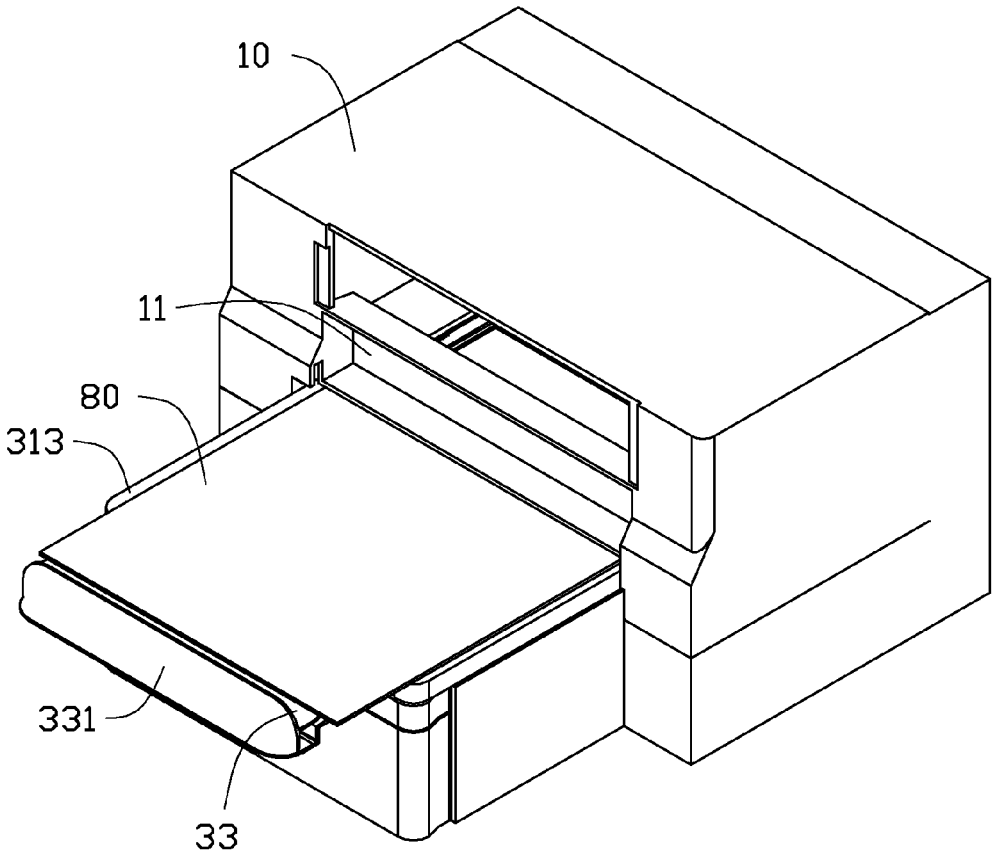
FIG. 8 is another assembled view of FIG. 1.

FIGS. 6-8 show that when the first paper 70 is outputted through the paper out opening 11, the controller 3135 receives a first size of the first paper 70 via a transmitter disposed in the printing body 10. The controller 3135 controls the drive 41 not to work, and the holding tray 33 is located in the first position. The bearing board 313 holds the first paper 70.

When the first paper 70 is replaced by the second paper 80 and the second paper 80 is outputted through the paper out opening 11, the controller 3135 gets a second size of the second paper 80 via the transmitter. The controller 3135 sends a first signal to the drive 41, then the drive 41 starts to work and drives the worm 43 to rotate. The rotation of the worm 43 drives the driving gear 50 to rotate, and the driving gear 50 drives the holding tray 33 to move out relative to the paper tray 31. When the holding tray 33 slides to the second position, the sensor 3112 sends a second signal to the controller 3135. The controller 3135 receives the second signal and sends the second signal to the drive 41. The drive 41 stops working. The holding tray 33 and the bearing board 313 cooperatively hold the second paper 80.

When the second paper 80 is replaced by the first paper 70 and the first paper 70 is outputted through the paper out opening 11, the controller 3135 receives the first size of the first paper 70 via the transmitter and sends the first signal to the drive 41. The drive 41 starts to work and rotates the worm 43. The rotation of the worm 43 rotates the driving gear 50. The driving gear 50 retracts the holding tray 33 relative to the paper tray 31. When the holding tray 33 slides to the first position, the sensor 3112 sends the second signal to the controller 3135. The controller 3135 receives the second signal and sends the second signal to the drive 41. The drive 41 stops working. The bearing board 313 holds the second paper 80.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A paper out mechanism comprising:

a paper tray;

a holding tray, the holding tray slidably attached to the paper tray; and an actuating device located on the paper tray and meshed with the holding tray, wherein the holding tray is slidable relative to the paper tray when the paper tray is driven by the actuating device;

a controller secured to the paper tray, the actuating device comprising a motor, and the motor being controlled by the controller; and the paper tray comprising an installation portion and a bearing board attached to the installation portion; a sensor located on the installation portion and electrically connected to the controller, the controller being installed on the bearing board, the sensor configured to send signals to the controller, and the controller being configured to control the actuating device to stop the holding tray from moving relative to the paper tray.

2. The paper out mechanism of claim 1, wherein the holding tray defines a receiving slot for receiving the actuating device, a plurality of teeth are located on one edge of the receiving slot, and the actuating device is meshed with the plurality of teeth.

3. The paper out mechanism of claim 2, wherein the receiving slot is substantially U-shaped.

4. The paper out mechanism of claim 1, wherein the actuating device further comprises a worm gear and a driving gear, and the driving gear is meshed with the worm gear and the holding tray.

5. The paper out mechanism of claim 4, wherein the driving gear comprises a first gear and a second gear, the first gear is meshed with the worm gear, and the second gear is meshed with the holding tray.

6. The paper out mechanism of claim 5, wherein the first gear has a first addendum circle, the second gear has a second addendum circle, and the first addendum circle is greater than the second addendum circle.

7. The paper out mechanism of claim 1, wherein two stopping posts are located on the bearing board, a locking member is located on the installation portion, and the two stopping posts are engaged with the locking member, to secure the bearing board to the installation portion.

8. The paper out mechanism of claim 1, wherein a blocking member is located on a distal edge of the holding tray and prevents papers from moving out of the holding tray.

9. A printing apparatus comprising:

a printing body; and a paper out mechanism secured to the printing body, the paper out mechanism comprising:

a paper tray comprising an installation portion and a bearing board attached to the installation portion;

a holding tray secured to the paper tray; and an actuating device located on the paper tray and meshed with the holding tray, wherein the holding tray is slidable relative to the paper tray between a first position and a second position; when the holding tray is located in the first position, the holding tray is located between the installation portion and the bearing board; when the holding tray is located in the second position, the holding tray extends out of the paper tray;

a controller secured to the paper tray, the actuating device comprising a motor, and the motor being controlled by the controller; and a sensor located on the installation portion and electrically connected to the controller, the controller being installed on the bearing board, the sensor configured to send signals to the controller, and the controller being configured to control the actuating device to stop the holding tray from moving relative to the paper tray.

10. The printing apparatus of claim 9, wherein the holding tray defines a receiving slot for receiving the actuating device, a plurality of teeth are located on one edge of the receiving slot, and the actuating device is meshed with the plurality of teeth.

11. The printing apparatus of claim 10, wherein the receiving slot is substantially U-shaped.

12. The printing apparatus of claim 9, wherein the actuating device further comprises a worm gear and a driving gear, and the driving gear is meshed with the worm gear and the holding tray.

13. The printing apparatus of claim 12, wherein the driving gear comprises a first gear and a second gear, the first gear is meshed with the worm gear, and the second gear is meshed with the holding tray.

14. The printing apparatus of claim 13, wherein the first gear has a first addendum circle, the second gear has a second addendum circle, and the first addendum circle is greater than the second addendum circle.

15. The printing apparatus of claim 9, wherein two stopping posts are located on the bearing board, a locking member is located on the installation portion, and the two stopping posts are engaged with the locking member, to secure the bearing board to the installation portion.

16. The printing apparatus of claim 9, wherein a blocking member is located on the holding tray and prevents papers from moving out of the holding tray.

* * * * *